US012269698B2

(12) United States Patent
Hada

(10) Patent No.: US 12,269,698 B2
(45) Date of Patent: Apr. 8, 2025

(54) PRINTER

(71) Applicant: TOSHIBA TEC KABUSHIKI KAISHA, Tokyo (JP)

(72) Inventor: Takaki Hada, Numazu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 156 days.

(21) Appl. No.: 17/983,335

(22) Filed: Nov. 8, 2022

(65) Prior Publication Data

US 2023/0303353 A1 Sep. 28, 2023

(30) Foreign Application Priority Data

Mar. 25, 2022 (JP) ..... 2022-049384

(51) Int. Cl.
*B65H 16/10* (2006.01)
*B65H 16/06* (2006.01)

(52) U.S. Cl.
CPC ..... *B65H 16/10* (2013.01); *B65H 16/06* (2013.01); *B65H 2301/3162* (2013.01); *B65H 2301/41346* (2013.01); *B65H 2801/03* (2013.01)

(58) Field of Classification Search
CPC ..... B65H 23/063; B65H 23/085; B65H 2301/4133; B65H 2301/3162; B65H 2301/41352
See application file for complete search history.

(56) References Cited

U.S. PATENT DOCUMENTS 9,027,867 B2 * 5/2015 Miyamoto ..... B65H 23/14 242/419.6
2011/0240788 A1 10/2011 Miyamoto
2017/0042392 A1 * 2/2017 Larsson ..... A47K 10/34

FOREIGN PATENT DOCUMENTS

JP 2000-016651 A 1/2000

* cited by examiner

*Primary Examiner* — Howard J Sanders
(74) *Attorney, Agent, or Firm* — Kim & Stewart LLP

(57) ABSTRACT

A printer for printing an image on a sheet stored in a rolled shape, includes a sheet holder by which the sheet in the rolled shape is rotatably held and including at least one side plate movable in a width direction of the sheet and contacting a side surface of the sheet, a printing head by which an image is printed on the sheet that has been conveyed from the sheet holder, a buffer unit between the sheet holder and the printing head and including a plate-shaped member that is connected to an elastic member that generates an elastic force by which the conveyed sheet is pressed, and an adjusting unit by which the movable side plate and the buffer unit is connected such that the elastic force varies depending on a location of the side plate.

16 Claims, 5 Drawing Sheets

| DAMPER FORCE [N] | WIDE ROLLED SHEET | NARROW ROLLED SHEET |
|---|---|---|
| 5 | GOOD | NOT ACCEPTABLE |
| 2 | GOOD | NOT ACCEPTABLE |
| 1 | ACCEPTABLE | NOT ACCEPTABLE |
| 0.6 | NOT ACCEPTABLE | GOOD |

PRINTER

CROSS-REFERENCE TO RELATED APPLICATION(S)

This application is based upon and claims the benefit of priority from Japanese Patent Application No. 2022-049384, filed Mar. 25, 2022, the entire contents of which are incorporated herein by reference.

FIELD

Embodiments described herein relate generally to a printer.

BACKGROUND

Conventionally, printers having the function of printing an image on a rolled sheet have become popular. Such printers perform printing while pulling out a rolled sheet. As the sheet is pulled out, the rolled sheet rotates. Here, when the rolled sheet is new and heavy immediately after replacement or replenishment, a large tension is required to pull out the sheet at the start of printing. The tension varies in accordance with a variation in the inertial force from the start to the stop of the rotation of the rolled sheet. Since the variation of the tension may adversely affect the quality of printing, various structures for suppressing the variation of the tension have been developed.

However, it is still difficult to suppress such variation in tension for various types of rolled sheet. Thus, there is a demand for a printer that can effectively suppress the variation in tension regardless of the types of rolled sheet.

SUMMARY OF THE INVENTION

Embodiments provide a structure for improving printing quality in a printer using rolled sheet.

In one embodiment, a printer for printing an image on a sheet stored in a rolled shape, includes a sheet holder by which the sheet in the rolled shape is rotatably held and including at least one side plate movable in a width direction of the sheet and contacting a side surface of the sheet, a printing head by which an image is printed on the sheet that has been conveyed from the sheet holder, a buffer unit between the sheet holder and the printing head and including a plate-shaped member that is connected to an elastic member that generates an elastic force by which the conveyed sheet is pressed, and an adjusting unit by which the movable side plate and the buffer unit is connected such that the elastic force varies depending on a location of the side plate.

DETAILED DESCRIPTION

First Embodiment

Figure 1:
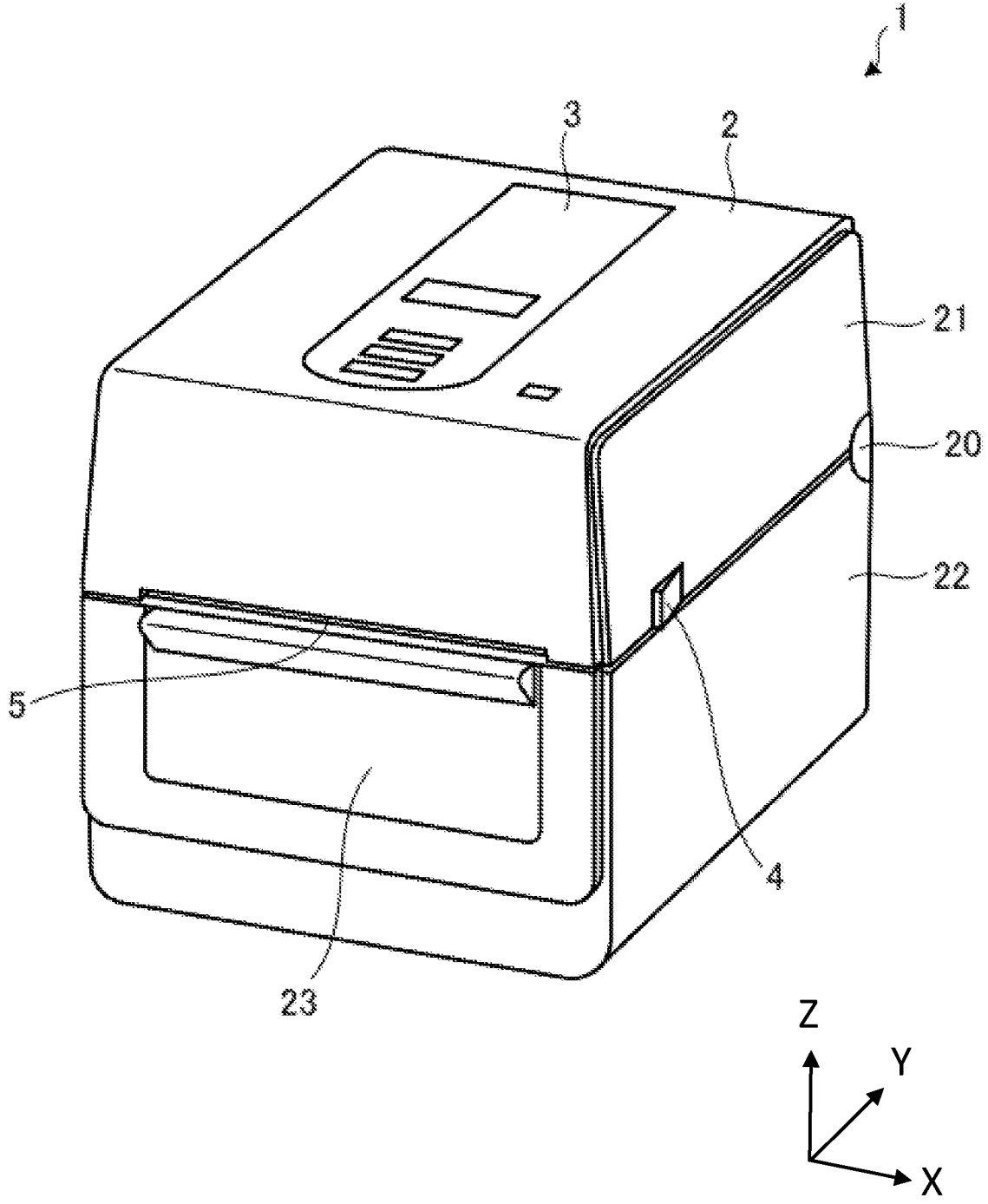
FIG. 1 is a perspective view of an external appearance of a printer according to a first embodiment as viewed from a front side thereof.

Exemplary embodiments will be described with reference to the drawings. FIG. 1 is a perspective view of an external appearance of a printer 1 according to a first embodiment as viewed from a front side. For convenience of explanation, a three-dimensional coordinate system is also shown. The width direction or left-right direction of the printer 1 is defined as the X-axis direction, the depth direction or front-rear direction is defined as the Y-axis direction, and the height direction or up-down direction is defined as the Z-axis direction. Further, the positive direction of the Y-axis is a direction from the front side to the back side, and a view towards the positive direction of the Y-axis is referred to as a front view. In addition, the positive direction of the Z-axis is a direction from the bottom to the top, and a view towards the negative direction of the Z-axis is referred to as a plan view. The positive direction of the X-axis is a direction from the left side to the right side in the front view. Note that a left side portion and a right side portion of the printer 1 when viewed from the front (i.e., in the positive direction of the Y-axis) are sometimes referred to as both side portions.

The printer 1 includes a housing 2, a display operation unit 3, an opening/closing button 4, and an issuing port 5. The housing 2 includes an upper case 21 and a lower case 22. The upper case 21 is rotatably attached to the lower case 22 by a hinge 20, and opens and closes with respect to the upper surface of the lower case 22 in accordance with the rotation.

The display operation unit 3 is an operation panel provided on the upper surface of the upper case 21. The display operation unit 3 receives input of various operations and displays various kinds of information. The opening/closing button 4 is provided on the front side of the side surface portion of the upper case 21, and receives an operation of releasing the locked state of the lock structure for holding the upper case 21 in the lower case 22.

The lower case 22 is a case having an upward opening, and the opening is covered by the upper case 21. The front surface of the lower case 22 includes a front cover 23. The issuing port 5 is an opening discharging a sheet such as a receipt, and is provided between an upper end portion of the front cover 23 and a lower end portion of the front surface of the upper case 21. The front cover 23 includes a sheet discharge guide at an upper end portion thereof. The sheet discharge guide guides the sheet discharged from the issuing port 5.

Figure 2:
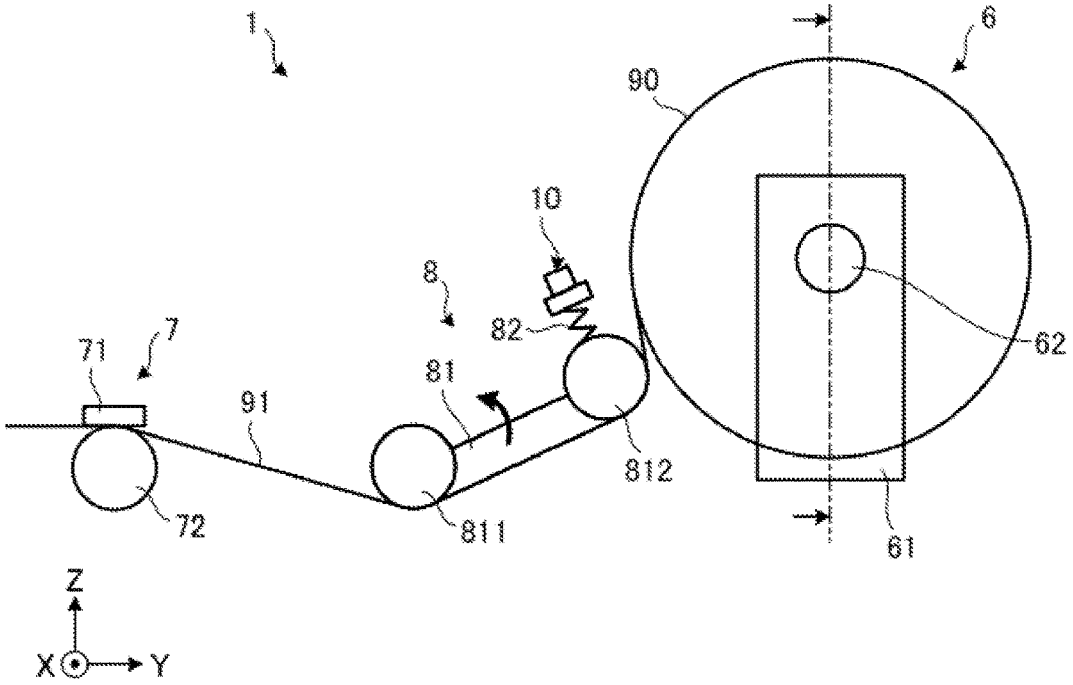
FIG. 2 is a schematic diagram of an internal configuration and a structure of the printer.

FIG. 2 is a schematic diagram of an internal configuration and a structure of the printer 1. The printer 1 further includes a sheet holding unit 6, a printing unit 7, and a buffer unit 8 in the housing 2.

The sheet holding unit 6 is a holder that stores and rotatably holds a rolled sheet 90 in which a belt-shaped sheet 91 is wound in a roll shape. Examples of the rolled sheet 90 include a receipt roll and a label roll. The receipt roll is formed by winding a belt-shaped receipt sheet. The receipt sheet is a belt-shaped sheet that is cut to form an individual receipt on which an image is printed. The label roll is formed by winding a belt-shaped label sheet. Examples of the label sheet include a label sheet in which a plurality of labels are attached to a belt-like mount, and a label sheet in which a plurality of labels are connected in a belt-like form. The label has a printing surface on which an image is printed and a back surface having an adhesive layer.

The printing unit 7 prints an image on the sheet 91 while conveying the sheet 91, and includes a print head 71 and a platen roller 72. The print head 71 is fixed to the inner surface of the upper case 21, and is in close contact with the platen roller 72 in a state where the upper case 21 covers the opening of the upper surface of the lower case 22. The print head 71 is, for example, a thermal head, and includes a plurality of heating elements provided in parallel, and prints on the sheet 91 sandwiched between the print heat 71 and the platen roller 72 by the heat of the heating elements. The platen roller 72 rotates by the driving force transmitted from a stepping motor, and conveys the sheet 91 sandwiched between the platen roller 72 and the print head 71.

Figure 3:
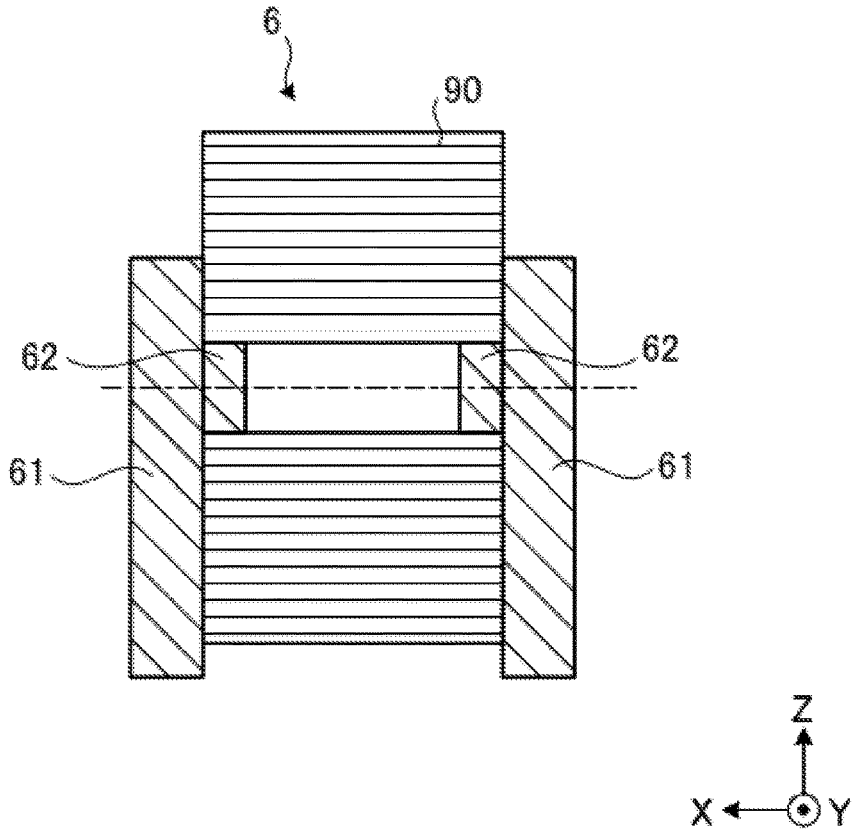
FIG. 3 depicts a sheet holding unit of the printer.

FIG. 3 depicts the sheet holding unit 6. The sheet holding unit 6 includes a pair of holding plates 61 and a pair of protruding portions 62. The pair of holding plates 61 is also referred to as holding members, and is provided so as to be able to change a distance between them, and is pressed so that the rolled sheet 90 does not move in the width direction by sandwiching the rolled sheet 90 positioned between each other from both side portions. The protruding portion 62 is provided on each holding plate 61 and protrudes toward the side end portion of the rolled sheet 90. The protrusion 62 rotatably supports the rolled sheet 90 by entering the cylindrical cavity at the center of the winding of the rolled sheet 90.

Returning to FIG. 2, the buffer unit 8 is provided between the sheet holding unit 6 and the printing unit 7, and absorbs fluctuations in the force required for the conveyance of the sheet 91, and includes a pressing member 81 and an elastic member 82. The pressing member 81 is a substantially rectangular plate-shaped member, and includes, at the ends thereof, a rotation shaft 811 and a pressing portion or shaft 812 extending substantially parallel to the X-axis.

The rotation shaft 811 is fixed to the housing 2 and serves as a rotation axis of the pushing member 81. The pressing portion 812 moves as the pressing member 81 rotates. The pressing portion 812 receives the elastic force of the elastic member 82, is pressed against the sheet 91.

The direction of pressing is a direction substantially orthogonal to the width direction of the sheet 91 and crossing the conveyance direction of the sheet 91. That is, the pressing portion 812 does not apply any force to the sheet 91 so as to move the sheet 91 in the width direction, and thus does not affect the conveyance of the sheet 91.

In the printer 1 having such a configuration, when the rolled sheet 90 is new and heavy after replenishment or the like, a large force is required to rotate the rolled sheet 90, and therefore, the tension required for pulling out the sheet 91 by the rotation of the platen roller 72 in the printing unit 7 is large. Further, when the rolled sheet 90 rotates and inertia acts, the tension decreases. Further, there is a slight time lag between the time when the printing is stopped and the drawing of the sheet 91 is stopped and the time when the rotation of the rolled sheet 90 is completely stopped. Therefore, the sheet 91 loosens before the printing unit 7. As a result, when printing is started, the printer 1 changes its state from a first state in which the loosened sheet 91 is pulled for printing to a second state in which the looseness disappears, the sheet 91 is tensioned, and the tension increases until the rolled sheet 90 starts to rotate, and then from the second state to a third state in which the rolled sheet 90 rotates stably. The buffer unit 8 mitigates the adverse effect by the looseness to improve printing accuracy.

As the sheet 91 is consumed and the weight of the rolled sheet 90 decreases, the tension in the second state decreases. As this tension decreases, the need for the action of the buffer unit 8 decreases. Therefore, the force of the buffer unit 8 is often set in accordance with the maximum weight of the rolled sheet 90.

The maximum weight of the rolled sheet 90 corresponds to the maximum diameter (i.e., the initial diameter when not in use) and width of the rolled sheet 90 to some extent. That is, when the diameter and width of the rolled sheet 90 are large, the weight of the rolled sheet 90 increases. The maximum diameter of the rolled sheet 90 is limited by the size of the sheet holding unit 6. Various types rolled sheet having different widths are supported by the printer 1.

Therefore, in the present embodiment, the force of the buffer unit 8 is changed in accordance with the width of the rolled sheet 90 by an adjusting unit 10 described next with reference to FIGS. 4 and 5. Specifically, the adjusting unit 10 increases the force of the buffer unit 8 when the sheet holding unit 6 holds the rolled sheet 90 having a large width, and decreases the force of the buffer unit 8 when the sheet holding unit 6 holds the rolled sheet 90 having a small width.

Figure 4A:
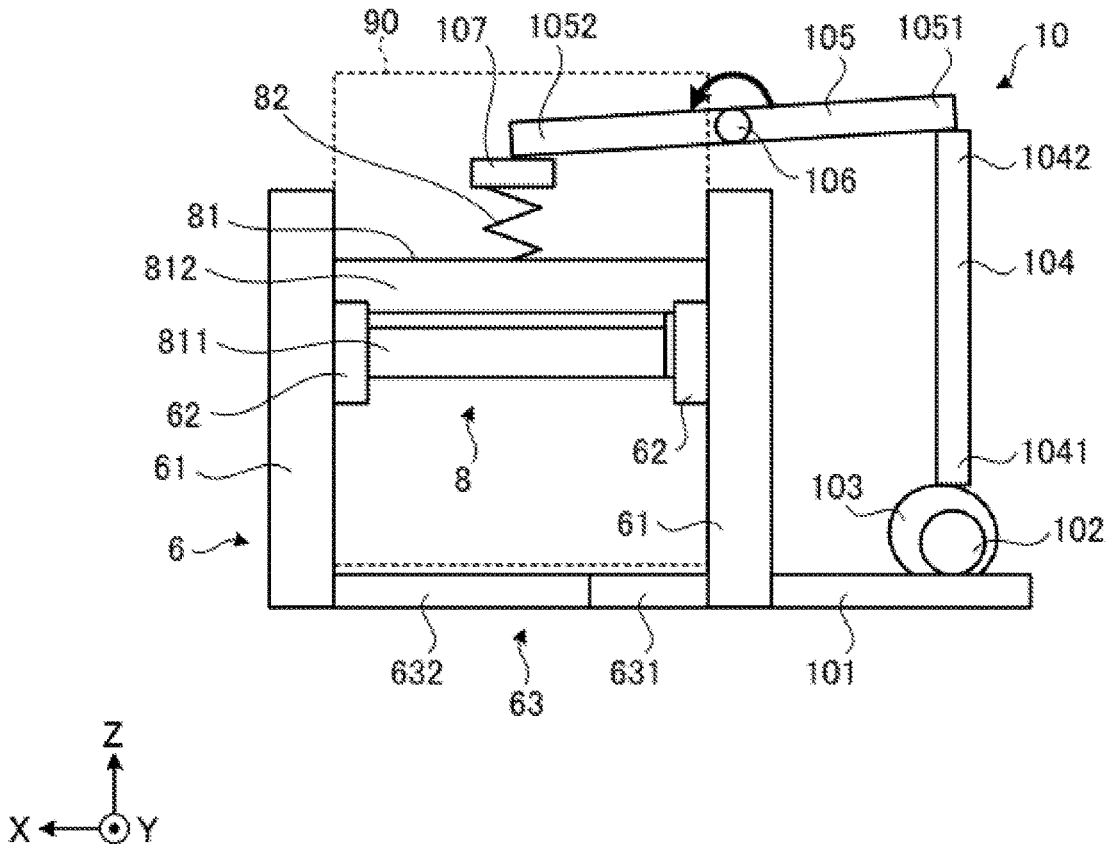
FIGS. 4A and 4B are diagrams of a configuration and a structure of an adjusting unit of the printer.
Figure 4B:
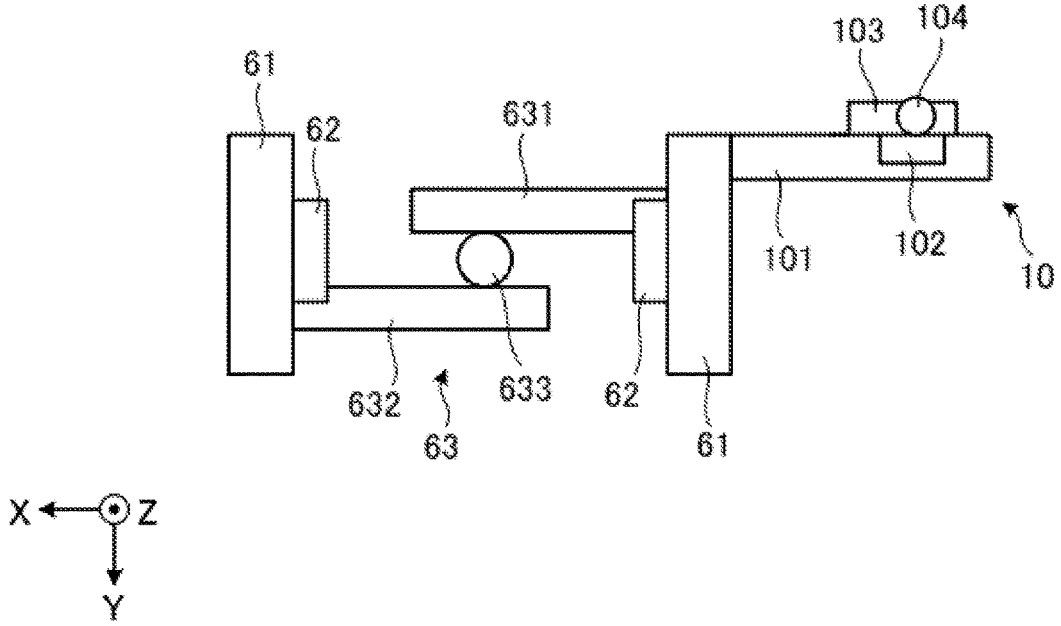

FIGS. 4A and 4B are diagrams of a configuration and a structure of the adjusting unit 10 of the printer 1, where FIG. 4A is a rear view and FIG. 4B is a plan view. FIG. 5 is a side view for explaining the operation of the adjusting unit 10. The adjusting unit 10 operates in linkage with the movement of the sheet holding unit 6, and adjusts the elastic force applied by the elastic member 82 to the pressing portion 812.

The sheet holding unit 6 includes a rack and pinion 63. The rack and pinion 63 includes a pair of rack gears 631 and 632 that are parallel to each other and face each other, and a pinion gear 633 that meshes with the rack gears 631 and 632.

The rack gear 631 is attached to one of the pair of holding plates 61, and the rack gear 632 is attached to the other. As a result, the rack and pinion 63 supports the pair of holding plates 61 so as to be movable in a direction in which they move away from each other. With such a structure, the rolled sheet 90 is aligned with respect to the center in the width direction.

The adjusting unit 10 includes a gear 101, a cam gear 102, an eccentric cam 103, a shaft 104, a rotation plate 105, a rotation shaft 106, and a pressing plate 107. These parts (i.e., the gear 101, the cam gear 102, the eccentric cam 103, the shaft 104, the rotation plate 105, the rotation shaft 106, and the pressing plate 107) constitute a link structure to operate simultaneously with each other.

The gear 101 is connected to one of the holding plates 61. The gear 101 is located on the opposite side of the rack gear 631 with the holding plate 61 interposed therebetween. The longitudinal direction of the gear 101 is substantially parallel to the longitudinal direction of the rack gear 631. As the holding plate 61 moves, the gear 101 moves in its longitudinal direction.

The cam gear 102 is a gear in which teeth are engraved on a cylindrical outer peripheral surface, and meshes with the gear 101. The cam gear 102 rotates as the gear 101 moves in accordance with the movement of the holding plate 61.

The eccentric cam 103 is a cam having an outer peripheral surface eccentric from the rotation center of the cam gear 102, and rotates with the rotation of the cam gear 102. When the eccentric cam 103 rotates, the position of the outer peripheral surface of the eccentric cam 103 in contact with the shaft 104 changes.

The shaft 104 is a shaft-like member, and is arranged such that one end portion 1041 thereof is in contact with the outer peripheral surface of the eccentric cam 103 and the other end portion 1042 is in contact with one end portion 1051 of the rotating plate 105.

Since the shaft 104 is disposed along the longitudinal (i.e., substantially vertical) direction and rests on the outer peripheral surface of the eccentric cam 103, it moves up and down in accordance with the rotation of the eccentric cam 103. In addition, as the shaft 104 moves up and down, one end portion 1051 of the rotating plate 105 moves up and down.

The rotation plate 105 is a plate-shaped member, and is rotatably supported at its central portion by the rotation shaft 106. As a result, the other end portion 1052 of the rotating plate 105 moves opposite to the first end portion 1051. That is, when the first end portion 1051 is raised, the second end portion 1052 is lowered, and when the first end portion 1051 is lowered, the second end portion 1052 is raised.

The second end portion 1052 of the rotation plate 105 is connected to the pressing plate 107. The pressing plate 107 moves up and down with the rotation of the rotation plate 105 accompanying the vertical movement of the shaft 104.

The pressing plate 107 holds the elastic member 82 between itself and the pressing portion 812 of the pressing member 81. The pressing plate 107 is positioned so as to press the elastic member 82 from above. The pressing plate 107 moves up and down as the second end portion 1052 moves up and down, thereby changing an elastic force applied to the pressing portion 812 by the elastic member 82.

With the above-described structure, in the printer 1 of the present embodiment, the adjusting unit 10 changes the force (hereinafter referred to as the damper force) of to press the sheet 91 by the buffering unit 8 in accordance with the dimension of the rolled sheet 90 in the width direction. Here, FIG. 6 is a diagram of a relationship between the damper force, the width of the rolled sheet 90, and the print quality. The unit of damper force is shown in Newtons [N]. Two types of rolled sheet 90 having the same diameter and different widths were compared as one example. Hereinafter, it is distinguished from a wide one as a narrow one. The print quality is shown in three stages of "good", "acceptable", and "not acceptable", for example.

The variation in the tension of the sheet 91 due to the transition from the first state to the third state affects the printing speed (i.e., the conveyance speed of the sheet 91). When the printing speed fluctuates, a printing jam, an elongation, or the like occurs in the printing conveyance direction. Therefore, variations in tension affect print quality or accuracy.

Figures 5, 6:
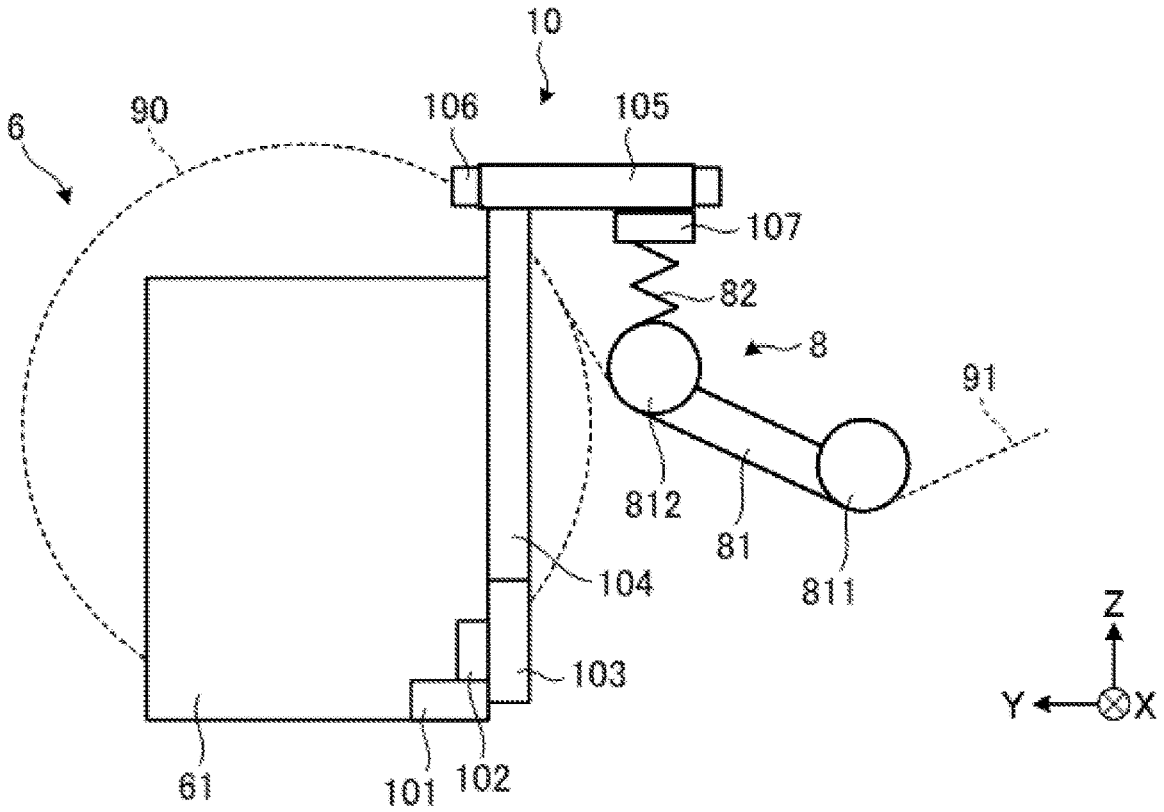
FIG. 5 is a side view of the adjusting unit 10.
FIG. 6 is a diagram of a relationship between a damper force, a width of a rolled sheet, and a print quality.

As shown in FIG. 6, in the rolled sheet 90 having a wide width, good print quality was obtained when the damper force was 2 to 5 [N], and the damper force was "good" in the case of 1 [N] and "not acceptable" in the case of 0.6 [N]. In the case of the rolled sheet 90 having a narrow width, good print quality was obtained when the damper force was 0.6 [N], and it was "not acceptable" when the damper force was 1 to 5 [N]. From this result, it is considered that at least a damping force of 1 [N] or more, preferably 2 to 5 [N] should be applied to the rolled sheet 90 of a certain width (wider in this case). From this result, it is considered that at least a damper force of about 0.6 [N] should be applied to the rolled sheet 90 having a certain width (narrower in this case), and a damper force of 1 [N] or more is not preferable.

As described above, according to the present embodiment, the printing quality in the printer 1 using the rolled sheet 90 can be maintained satisfactorily regardless of the width of the rolled sheet 90.

Second Embodiment

Next, a second embodiment which is a modification of the above-described embodiment will be described. Since the present embodiment is a modification of the first embodiment, the same reference numerals are used for the same parts as those of the first embodiment, and description thereof will be omitted.

Figure 7A:
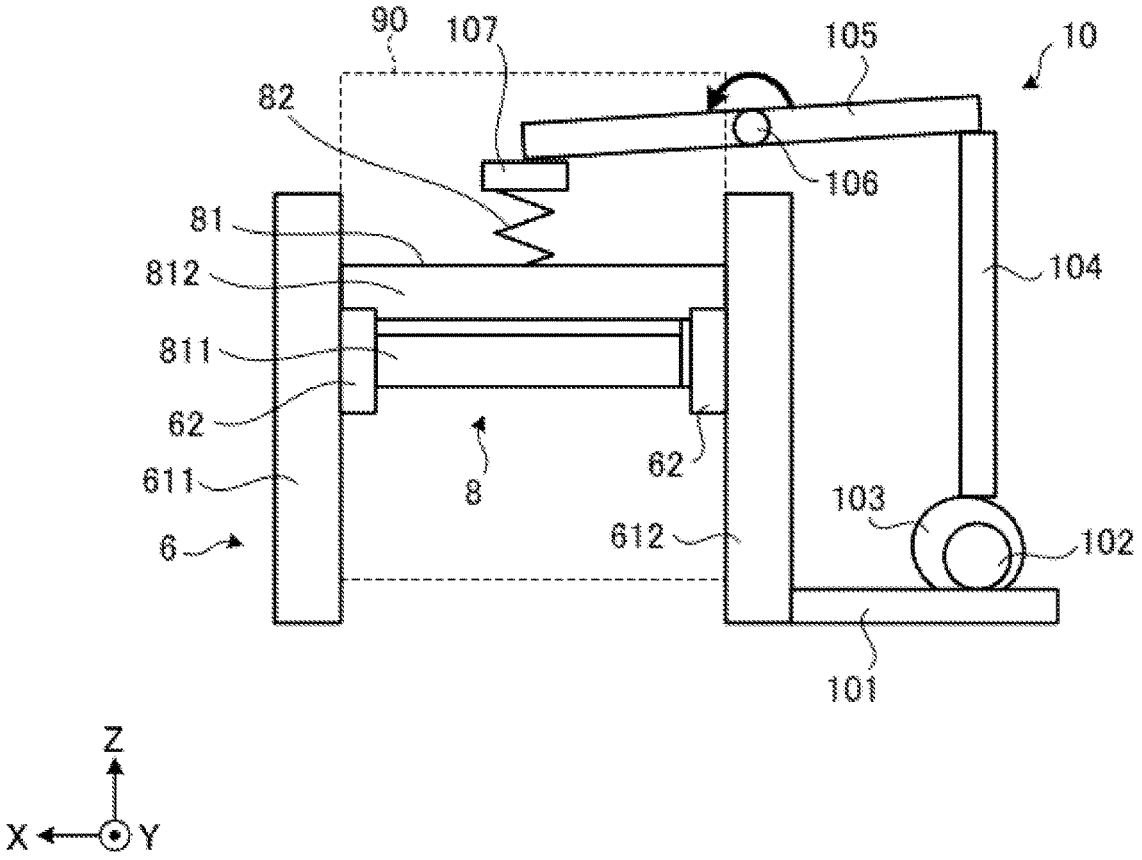
FIGS. 7A and 7B are diagrams of a configuration and a structure of an adjusting unit of a printer according to a second embodiment.
Figure 7B:
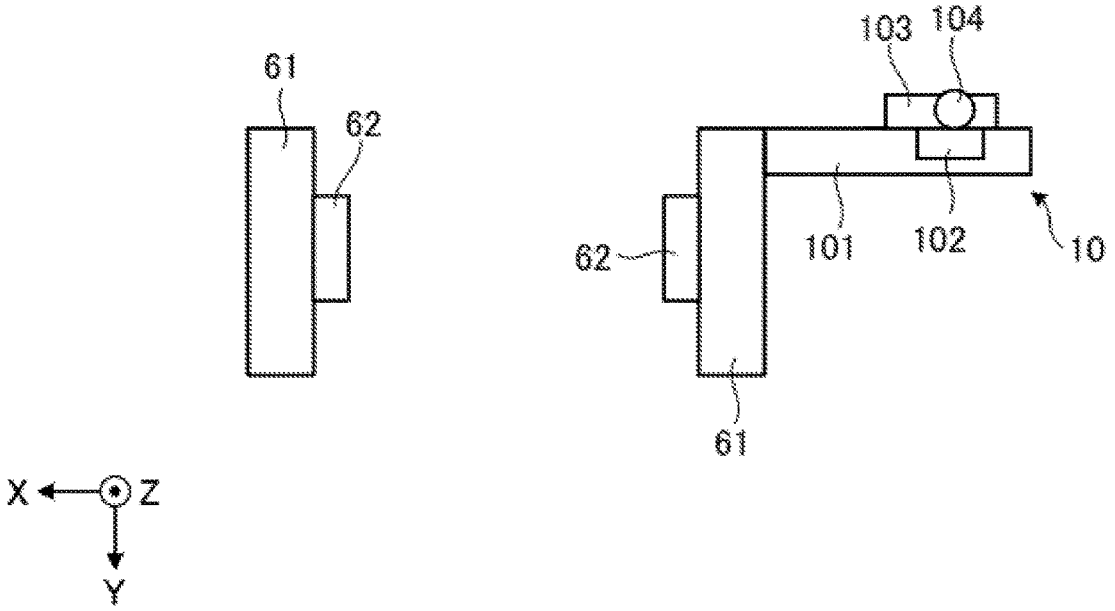

FIGS. 7A and 7B are diagrams of a configuration and a structure of an adjusting unit 10 according to the second embodiment, wherein FIG. 7A is a rear view of the adjusting unit 10 and FIG. 7B is a plan view thereof. The sheet holding unit 6 of the first embodiment is aligned with the center of the sheet 91 in the width direction as a reference, but the sheet holding unit 6 of the present embodiment is of a one-sided type. That is, the holding plates 611 is fixed, and only the holding plate 612 is movable in the sheet width direction.

In such a configuration, the gear 101 is coupled to the holding plate 612 and moves along with the movement of the holding plate 612. According to such a configuration, even if the sheet holding unit 6 is biased, the same effects as those of the first embodiment can be obtained.

While certain embodiments have been described, these embodiments have been presented by way of example only, and are not intended to limit the scope of the disclosure. Indeed, the novel embodiments described herein may be embodied in a variety of other forms; furthermore, various omissions, substitutions and changes in the form of the embodiments described herein may be made without departing from the spirit of the disclosure. The accompanying claims and their equivalents are intended to cover such forms or modifications as would fall within the scope and spirit of the disclosure.

What is claimed is:

1. A printer for printing an image on a sheet stored in a rolled shape, comprising:

a sheet holder by which the sheet in the rolled shape is rotatably held and including at least one side plate movable in a width direction of the sheet and contacting a side surface of the sheet;

a printing head by which an image is printed on the sheet that has been conveyed from the sheet holder;

a buffer unit between the sheet holder and the printing head and including a plate-shaped member that is connected to an elastic member that generates an elastic force by which the conveyed sheet is pressed; and an adjusting unit by which the movable side plate and the buffer unit are connected such that the elastic force varies depending on a location of the side plate, wherein the adjusting unit includes:

a rotation plate, one end of which is connected to the elastic member, and which rotates when the location of the side plate is changed, a shaft, one end of which is connected to the other end of the rotation plate, a first gear connected to the side plate and movable therewith along the width direction, a second gear that engages with the first gear to rotate therewith, and an eccentric cam that engages with the second gear and is connected to the other end of the shaft.

2. The printer according to claim 1, wherein the elastic force is greater when the location of the side plate is farther from a center of the sheet in the width direction.

3. The printer according to claim 1, wherein when the side plate is moved toward a direction away from a center of the sheet, the shaft moves upward according to the rotation of the eccentric cam such that the rotation plate rotates and the elastic force is increased.

4. The printer according to claim 1, wherein the sheet holder has a rack and pinion gear mechanism by which the sheet is held at a center of the sheet holder in the width direction.

5. The printer according to claim 1, wherein the sheet holder includes another side plate on an opposite side of the sheet with respect to said at least one side plate and fixed at a predetermined position.

6. The printer according to claim 1, wherein the buffer unit includes a rotation shaft contacting the conveyed sheet and around which the buffer unit rotates.

7. The printer according to claim 1, wherein the elastic force is between 0.6 N and 5 N.

8. The printer according to claim 1, further comprising:

a housing in which the sheet holder, the printing head, the buffer unit, and the adjusting unit are housed, and having an issuing port through which the sheet on which the image is printed is issued.

9. The printer according to claim 8, wherein the issuing port is located on a front side of the printing head, and the sheet holder is located on a rear side of the printing head.

10. The printer according to claim 8, wherein the housing includes an upper case and a lower case, and the upper case is rotatable around a hinge located on one of side surfaces of the housing facing another side surface along which the issuing port is disposed.

11. The printer according to claim 8, further comprising:

an operation panel along a top surface of the housing.

12. The printer according to claim 1, wherein the sheet includes a plurality of labels each having a front surface on which an image is printed and a rear surface on which an adhesive is applied.

13. A printer for printing an image on a sheet stored in a rolled shape, comprising:

a sheet holder by which the sheet in the rolled shape is rotatably held and including at least one side plate movable in a width direction of the sheet and contacting a side surface of the sheet;

a printing head by which an image is printed on the sheet that has been conveyed from the sheet holder;

an elastic member between the sheet holder and the printing head;

a pressing shaft that is pressed against the conveyed sheet by the elastic member;

a rotation plate, one end of which is connected to the elastic member, and which rotates when a location of the side plate is changed;

another shaft, one end of which is connected to the other end of the rotation plate;

a first gear connected to the side plate and movable therewith along the width direction;

a second gear that engages with the first gear to rotate therewith; and an eccentric cam that engages with the second gear and is connected to the other end of said another shaft, wherein an elastic force that is applied by the elastic member to the pressing shaft varies depending on the location of the side plate.

14. The printer according to claim 13, wherein the elastic force is greater when the location of the side plate is farther from a center of the sheet in the width direction.

15. The printer according to claim 13, wherein when the side plate is moved toward a direction away from a center of the sheet, said another shaft moves upward according to the rotation of the eccentric cam such that the rotation plate rotates and the elastic force is increased.

16. The printer according to claim 13, wherein the sheet holder has a rack and pinion gear mechanism by which the sheet is held at a center of the sheet holder in the width direction.

* * * * *